United States Patent [19]

Stewart

[11] 4,112,622

[45] Sep. 12, 1978

[54] ROLLER ASSEMBLY FOR SLIDING SCREEN DOOR, AND THE LIKE

[75] Inventor: David E. Stewart, Los Angeles, Calif.

[73] Assignee: Empire Metal Products Corp., Los Angeles, Calif.

[21] Appl. No.: 720,888

[22] Filed: Sep. 7, 1976

[51] Int. Cl.[2] ..... E05D 13/02; E05D 15/16

[52] U.S. Cl. ..... 49/421; 16/91; 16/97; 49/425

[58] Field of Search ..... 49/421, 420, 425, 417; 16/91, 97; 160/345

[56] References Cited

U.S. PATENT DOCUMENTS

| | | | |
|---|---|---|---|
| 1,578,277 | 3/1926 | Geschickter | 49/417 |
| 2,637,878 | 5/1953 | Watkins | 49/420 |
| 2,867,859 | 1/1959 | Brink et al. | 49/420 |
| 3,284,953 | 11/1966 | Rifkin | 49/421 X |
| 3,290,824 | 12/1966 | Anderson | 49/420 |
| 3,713,473 | 1/1973 | Ford | 160/345 |
| 3,731,431 | 5/1973 | Banner | 49/420 |

*Primary Examiner*—Philip C. Kannan
*Attorney, Agent, or Firm*—Keith D. Beecher

[57] ABSTRACT

A roller assembly is provided for a sliding screen door, and the like, which includes a housing adapted to be supported as a friction fit in an opening in the edge of the door, and which also includes a roller supported in the housing. The roller may be spring-biased by a flat spring member which constitutes a resilient support for the roller and which is hooked into the housing.

6 Claims, 5 Drawing Figures

ROLLER ASSEMBLY FOR SLIDING SCREEN DOOR, AND THE LIKE

BACKGROUND OF THE INVENTION

It is usual in the prior art to provide sliding screen doors, and the like, with rollers supported in channels in the top and bottom edges of the door. The rollers, in turn, ride on appropriate tracks on the top and bottom of the door opening. It is also usual in the prior art for the top rollers to be spring-biased so as to permit the door to be positioned in the tracks by a simple manipulation, and to permit the doors to be easily removed from the tracks when so desired.

However, the mounting of the rollers in the top and bottom channels of the door, and especially the mounting of the spring-loaded rollers, has required excessively complicated mounting brackets and assemblies in the prior art, which have proven to be difficult to make and to install during the fabrication of the doors.

A principal object of the present invention is to provide a simple and inexpensive roller assembly which may be mounted in channels in the upper and lower edges of a screen door, and the like, merely by inserting each roller assembly into a corresponding opening in the channels, in a simple friction fit relationship therewith.

DETAILED DESCRIPTION OF THE ILLUSTRATED EMBODIMENT

Figure 1:
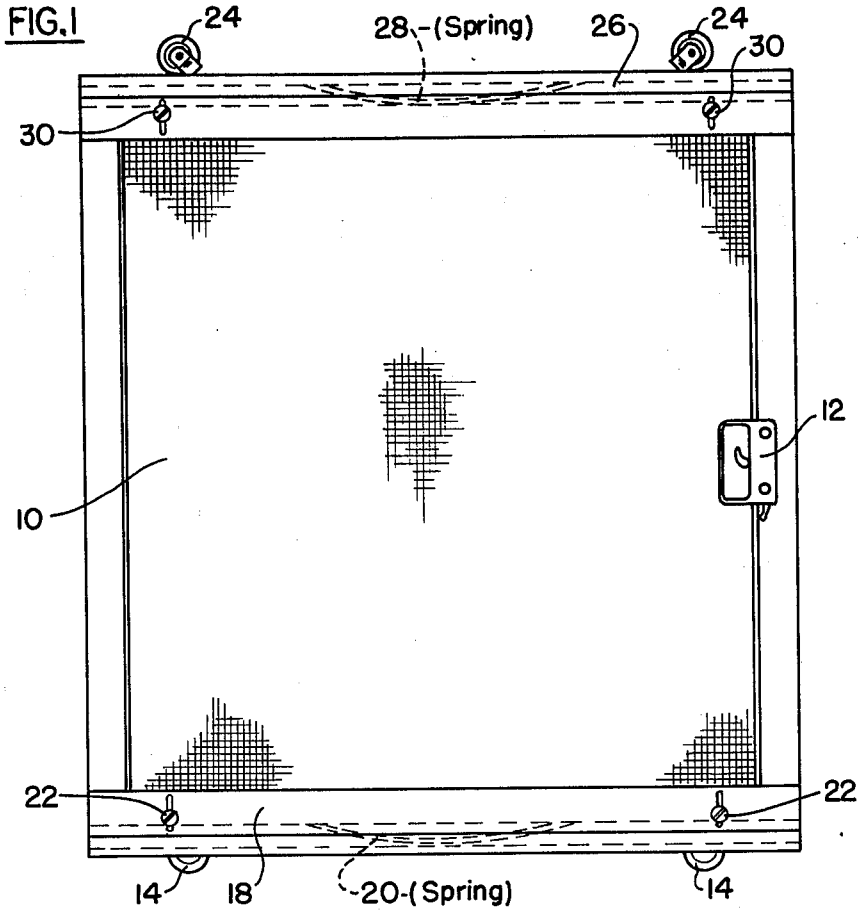
FIG. 1 is a plan view of a screen door having roller assemblies mounted therein in accordance with the present invention.

A screen door 10 is shown in FIG. 1 which is of the sliding type, and which is adapted to be supported in appropriate tracks extending along the bottom and along the top of a door opening. The sliding screen door 10 is opened and closed by an appropriate handle and latch 12. The door is supported on the lower track by rollers 14 which are rotatably supported in housings, such as the housing 16 (FIG. 5), the housing being mounted on an elongated bracket or bonnet 18 which extends across the bottom of door 10.

Elongated bracket 18 is spring-biased by a resilient U-shaped strip 20, and it may be set to any appropriate position by set screws 22, so that the door may fit openings of different heights.

A pair of rollers 24 are mounted in a similar elongated bracket or bonnet 26 at the top of the door. Bracket 26 is spring-biased by means of a U-shaped resilient strip member 28, and it may be set at a desired position with respect to the door by means of set screws 30.

The rollers 14 ride on the bottom track of the door opening, and the rollers 24 ride on the top track. Rollers 24 are spring-biased so as to facilitate the placement and removal of the door with respect to the door opening.

Figure 5:
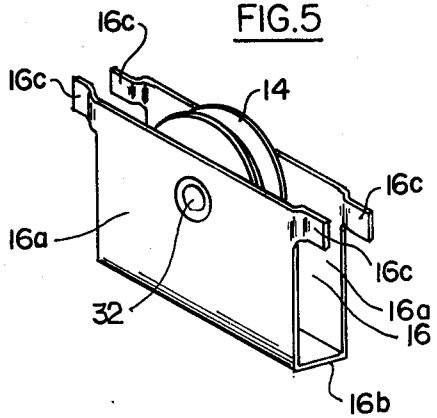
FIG. 5 is a perspective representation of a roller assembly, two of which are mounted in the bottom of the door of FIG. 1.
Figure 3:
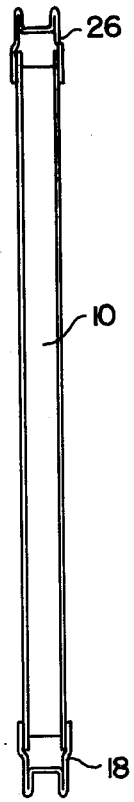
FIG. 3 is a side view of the door of FIG. 1.

As shown in FIG. 5, the housing 16 is open-topped and open-ended, and it is formed of two parallel sides

16*a* and an integral interconnecting bottom 16*b*. Lugs 16*c* are formed at the top of each side, at each end thereof, and these lugs extend longitudinally outwardly from the housing 16 to permit the housing to be suspended in an appropriate opening in a channel formed in the bottom edge of the bracket member 18. Such openings are provided with a length corresponding to the length of housing 16 and with a width corresponding to the width of the channel. When the housing is inserted into the opening, the lugs extend beyond the ends of the opening so as to suspend the housing in the opening. The roller 14 is rotatably supported on a pin or axle 32 which is mounted on the sides 16*a* in fixed relationship therewith, and which extends transversely across the housing. The housing is held in place in the aforesaid opening merely by a friction fit relationship between the sides of the housing and the sides of the channel formed in the bottom edge of bracket 18.

The spring-biased rollers 24 are supported in a housing 34 which is similar to housing 16. Housing 34, however, has a hook member 36 formed in its bottom, and the hook member supports a U-shaped resilient strip member 38. The strip member 38 has a hold in one end which engages hook 36 which retains the strip member in its proper position, and it has two spaced and parallel sides 40 formed integral with its other end which serve as support brackets for rotatably supporting the roller 24. Roller 24 is supported on an axle 41 which extends transversely between the sides 40 in fixed relationship therewith.

Figure 4:
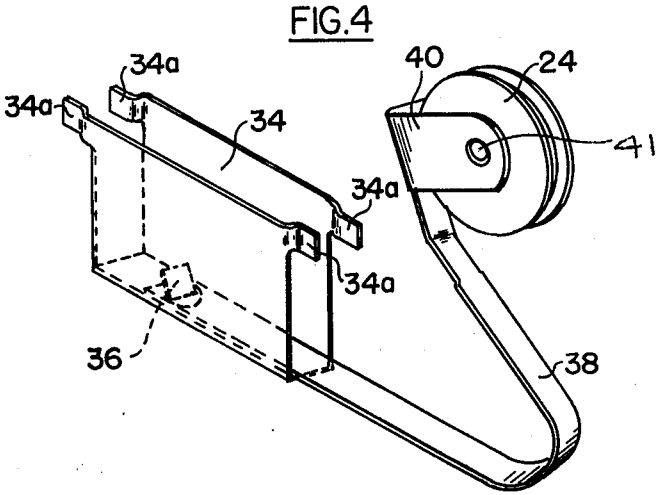
FIG. 4 is a perspective view of a spring-loaded roller assembly, two of which are mounted in the top of the door of FIG. 1.
Figure 2:
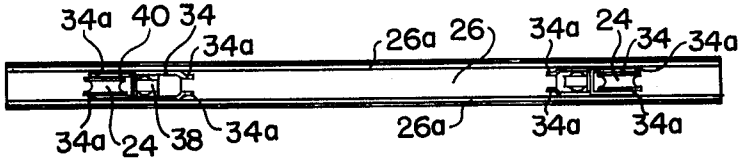
FIG. 2 is a top view of the door of FIG. 1.

Two assemblies of the type shown in FIG. 4 are supported in the upper edge of the elongated bracket 26, and each is suspended in a corresponding opening in a channel formed in the top edge of bracket 26, and in the same manner as the housing 16 is supported in the channel at the bottom edge of bracket 18. Each housing 34 is supported within the corresponding opening by means of lugs 34*a*, as best shown in FIG. 2. The individual housings are retained in the openings, merely by inserting the housings into the openings with the sides of the housings forming a frictional fit with the sides of the openings.

The invention provides, therefore, a simple and expeditious construction for a roller assembly for use in conjunction with a sliding screen door, or the like. The assembly of the invention may be quickly and easily installed in a screen door during the fabrication process, and is securely held in place by the simple interference or friction fit relationship.

While particular embodiments of the invention have been shown and described, modifications may be made. It is intended in the claims to cover all modifications which come within the true spirit and scope of the invention.

What is claimed is:

1. In combination: a roller assembly and a sliding screen door, said door having a channel in the edge thereof, and an opening in the channel for receiving the roller assembly, said roller assembly comprising: an open-ended, open-topped housing having a pair of parallel sides adapted to fit into said opening and having integral lugs formed on said sides adjacent the upper edges thereof and adapted to extend beyond the edges of said opening to enable the housing to be suspended into said opening; and a roller mounted in said housing for rotation about an axis extending transversely with respect to said housing.

2. The roller assembly defined in claim 1, in which each of said sides has a rectangular shape.

3. The roller assembly defined in claim 1, in which the sides of said housing engage the sides of the opening in a friction fit relationship to cause the housing to be retained in the opening.

4. The roller assembly defined in claim 1, and which includes an axle extending transversely across said housing in a fixed relationship therewith for supporting the roller.

5. The roller assembly defined in claim 1, in which said housing has a bottom formed integral with the sides thereof; a hook formed in said bottom; and a resilient strip member engaging said hook and resiliently supporting said roller with respect to said housing for movement into and out of said opening.

6. The roller assembly defined in claim 5, in which said resilient strip member has a U-shape, and has a hole at one end for receiving the hook, and further has a pair of spaced parallel side members integral with the other end thereof; and pin means mounted in said last-named flat members in fixed transverse relationship therewith for rotatably supporting said roller.

* * * * *